US006834585B2

(12) United States Patent
Hahn

(10) Patent No.: US 6,834,585 B2
(45) Date of Patent: Dec. 28, 2004

(54) CYLINDER OF ROTATIONAL PRINTING PRESS

(75) Inventor: Oliver Frank Hahn, Veitshöochheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/148,882

(22) PCT Filed: Dec. 21, 2000

(86) PCT No.: PCT/DE00/04577

§ 371 (c)(1),
(2), (4) Date: Jun. 14, 2002

(87) PCT Pub. No.: WO01/45947

PCT Pub. Date: Jun. 28, 2001

(65) Prior Publication Data

US 2002/0178947 A1 Dec. 5, 2002

(30) Foreign Application Priority Data

Dec. 21, 1999 (DE) ..... 199 61 574

(51) Int. Cl.[7] ..... B41F 13/10
(52) U.S. Cl. ..... 101/378; 101/216; 101/375
(58) Field of Search ..... 101/216, 217, 101/218, 220, 375, 376, 378, 382.1, 415.1; 492/30, 36

(56) References Cited

U.S. PATENT DOCUMENTS

| | | | | | |
|---|---|---|---|---|---|
| 872,004 | A | * | 11/1907 | McCain et al. | 101/378 |
| 894,200 | A | * | 7/1908 | Goss | 270/5.01 |
| 1,357,341 | A | * | 11/1920 | Novotny | 101/378 |
| 1,479,446 | A | * | 1/1924 | Bauer | 101/384 |
| 3,166,012 | A | * | 1/1965 | Hantscho | 101/220 |
| 3,395,638 | A | * | 8/1968 | Kirkus et al. | 101/216 |
| 4,332,194 | A | * | 6/1982 | Gensheimer | 101/216 |
| 4,878,429 | A | * | 11/1989 | Russo | 101/486 |
| 4,974,512 | A | * | 12/1990 | Russo | 101/389.1 |
| 5,038,680 | A | * | 8/1991 | Bain | 101/401.1 |
| 5,069,127 | A | | 12/1991 | Iijima et al. | |
| 6,408,747 | B2 | * | 6/2002 | Koppelkamm et al. | 101/147 |

FOREIGN PATENT DOCUMENTS

| | | | | |
|---|---|---|---|---|
| CH | 345906 | | 6/1960 | |
| DE | 198 03 809 A1 | | 8/1999 | |
| FR | 2 276 177 | | 6/1975 | |
| GB | 1 476 707 | * | 6/1977 | B41F/13/08 |
| JP | 10-071694 A | | 3/1998 | |
| WO | WO 89/11393 | | 11/1989 | |

* cited by examiner

*Primary Examiner*—Andrew H. Hirshfeld
*Assistant Examiner*—Leo T. Hinze
(74) *Attorney, Agent, or Firm*—Jones Tullar & Cooper, PC

(57) ABSTRACT

A cylinder of a rotary printing machine has at least two axially extending cylinder channels on its peripheral surface. These two cylinder channels are offset circumferentially at an angle which is determined depending on the inherent bending frequency vibration $f_{vib}$ of the cylinder.

8 Claims, 2 Drawing Sheets

CYLINDER OF ROTATIONAL PRINTING PRESS

FIELD OF THE INVENTION

The present invention is directed to a cylinder of a rotary printing press. Two channels in the cylinder are offset with respect to each other in the circumferential direction.

BACKGROUND OF THE INVENTION

DE 198 03 809 A1 and JP 10-071694A disclose transfer cylinders of a printing press with channels which are arranged offset by 180°.

SUMMARY OF THE INVENTION

The object of the present invention is directed to providing a cylinder for a rotary printing press.

In accordance with the present invention, this object is attained by providing the cylinder with at least two channels or grooves which are situated on the surface of the cylinder and which are offset at an angle in the circumferential direction of the cylinder. The angular offset is determined as a function of the inherent bending frequency of the cylinder. This offset is preferably between 5° and 40°.

The advantages which can be achieved by the present invention primarily lie in that the amplitude of the cylinder vibration is minimized by passive vibration damping.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

The amplitude of the resultant total vibration of a cylinder of a rotary printing machine, within a definable rate of production range, is minimized, in accordance with the present invention by the destructive interference of the vibration excited by sequential channel impacts. For this purpose, the destructively interfering channel impacts must follow each other closely in order to best meet the interference conditions with respect to amplitude and phase relationships, for (a) comparable amplitudes, i.e. the lowest possible vibration damping between the interfering channel impacts, lead to the greatest possible obliteration, (b) the phase relationship, i.e. the chronological distance between the interfering channel impacts should vary as little as possible with the production rates in order to receive the obliteration over a wide range of production rates.

Figure 1:
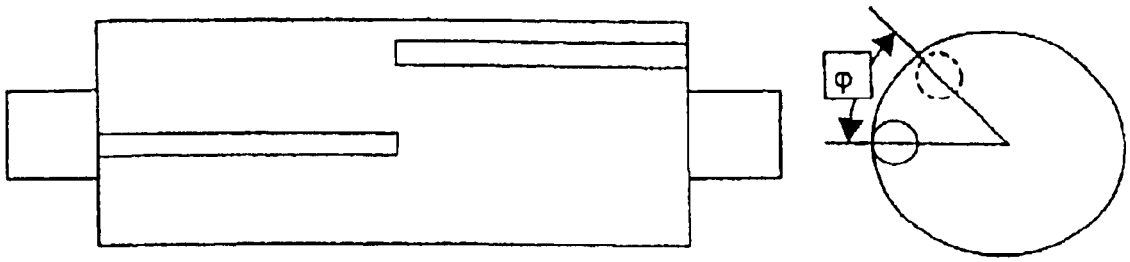
FIG. 1, a cylinder useable for performing printing and having a split channel with channel halves which are offset by an angle $\phi$, FIG. 2, a cylinder useable for performing printing, having three channels offset by an angle $\phi$, FIG. 3, a cylinder for performing printing, having four channels offset by an angle $\phi$, FIG. 4, an arrangement of channels in cooperating cylinders of equal circumference for performing printing, and in FIG. 5, a graph showing vibration amplitudes after overrolling the pair of channels shown in FIG. 1 in comparison to overrolling a single continuous channel, or one extending over half the barrel width. The amplitudes relate to an "isolated" overrolling, i.e. an amplitude amplification by previous, not terminated overrolling is not taken into consideration.
Figure 2:
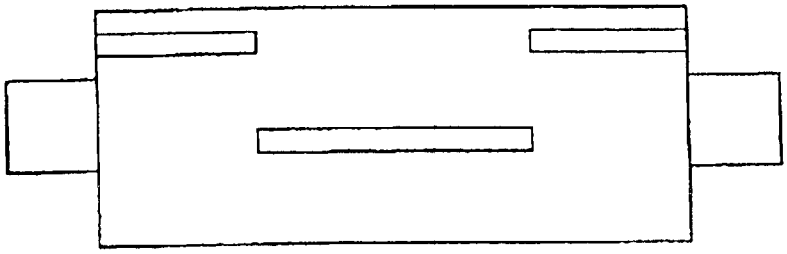
Figure 3:
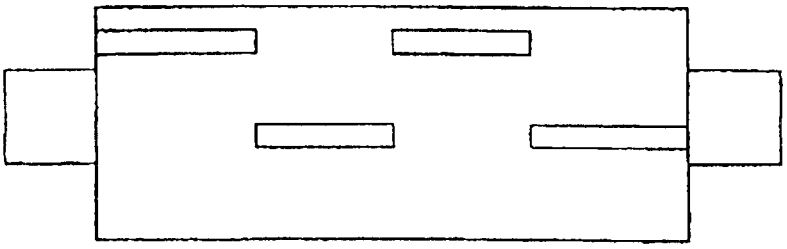

As represented in FIG. 1 to 3, each cylinder performing printing has split channels.

The split channels of each cylinder depicted in FIGS. 1 to 3 are offset from each other by a defined angle $\phi$, for example 5° to 40°, or more specifically 13° to 21°, and most preferably in particular 16° to 18°.

The angle of offset $\phi$ for each channel is derived from the inherent bending frequency $f_{vib}$ of the cylinder and the rotation frequency $f_{rot}$, at which the amplitude should be minimal, and is calculated as $$\phi=(f_{rot}/f_{vib})*180°$$

In the course of the structural conversion, a deviation of up to ±20% from the angle $\phi$ calculated in this way is permitted.

Figure 4:
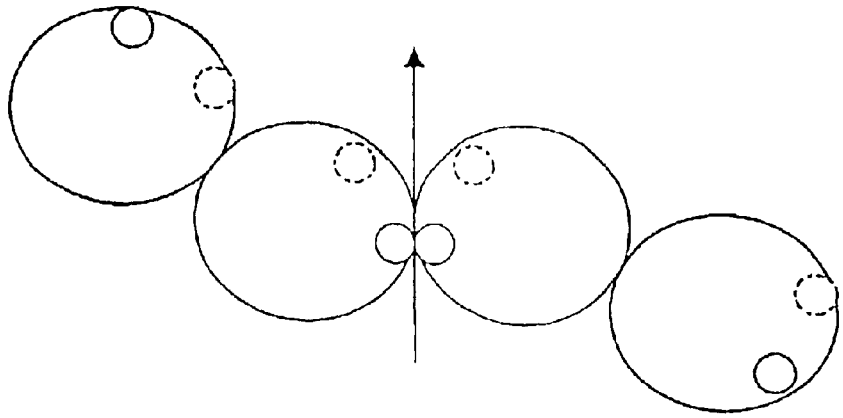

The channels of adjoining, cooperating printing cylinders of equal circumference are arranged in such a way that the respective channels on the adjoining cylinders roll off on each other, as seen in FIG. 4.

The channels of adjoining printing cylinders, wherein a cylinder of double circumference is arranged next to a cylinder of single circumference, are arranged in such a way that the channels roll off on each other during every, or every second, revolution of the cylinder of single circumference.

Efficiency of the Vibration Damping

In the following discussion, the angularly offset channels represented in FIG. 1 and which are offset by the angle $\phi$, as calculated in accordance with the above equation, and which cylinder with channels is rolling off a similar cylinder, as depicted in FIG. 4, are called a "channel pair". The resultant vibration amplitude after the channel pair has been rolled over, compared with the roll-over of a pair of cylinders each with a single channel extending over the entire barrel width, as well as in comparison with the roll-over of a pair of cylinders each with a single channel extending over half the barrel width, is shown by way of example in FIG. 5 in connection with an angle $\phi$, which is optimized for the production rate of 70,000 pieces, for example newspaper pages, per hour.

Figure 5:
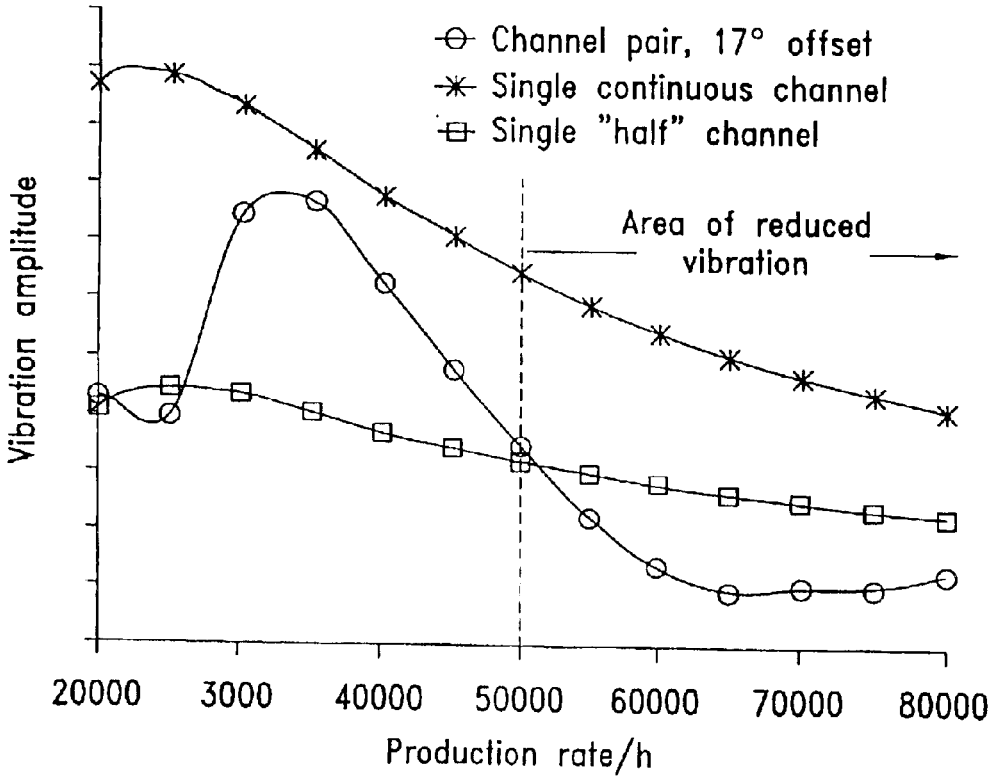

The vibration-technological advantages of a cylinder in accordance with the present invention for performing printing and having a channel pair offset in accordance with the present invention, over cylinders performing printing with divided channels, which are offset by a different, generally known angle typically of 90° or 180°, and called in what follows "conventionally staggered", are twofold:

Initially, following the roll-over of the channel pair, the vibration amplitude because of the destructive interference of the channel pair of the present invention is lower, by up to 60%, than the vibration amplitude after the roll-over of a single split channel as shown in the graph of FIG. 5.

Secondly, following the roll-over of the channel pair of the present invention, the excited vibration has available essentially the entire cylinder rotation time $1/f_{rot}$ for decay while, with conventionally staggered cylinders, another channel impact occurs within the same cylinder rotation time. This is of importance particularly in connection with high production rates, wherein an amplitude amplification, because of the superimposition of non-decayed vibrations, takes place.

The cooperation of both of the above discussed effects increases the efficiency of the vibration damping beyond the amount represented in FIG. 5.

Comparison of the Structural Designs in FIGS. 1 to 3

The first harmonic vibration of the bending vibration adds substantially to the total vibration amplitude after roll-over of the channel pair. Because the force introduction of the structural design in accordance with FIG. 2—in contrast to the embodiments in accordance with FIG. 1 and FIG. 3—does not have the symmetry of the first harmonic vibration, the latter is much less excited in the embodiment in accordance with FIG. 2. Opposed to this is the disadvantage of the embodiment in accordance with FIG. 2 that one channel impact takes place "on the outside", and the other "on the inside". This generally causes an excitation of varying strength of the base vibration, and therefore a reduction of the vibration damping by destructive interference.

The embodiment of FIG. 1 is believed to be favored over the embodiments in accordance with FIG. 2 and FIG. 3 in view of the possibilities of its use for panoramic printing, as well as the simplicity of introducing the mechanical clamping channel elements which it provides.

As a whole, the embodiment in accordance with FIG. 1 thus represents the most favorable embodiment of the present invention.

The cylinder is preferably provided as a forme cylinder or as a transfer cylinder with channels for fastening printing plates or rubber blankets to the peripheral surface of the cylinder.

While a preferred embodiment of a cylinder of a rotational printing press in accordance with the present invention has been fully and completely described hereinabove, it will be apparent to one of skill in the art that a variety of changes in, for example, the drive for each cylinder, its support in the rotary printing machine, and the like can be made without departing from the true spirit and scope of the present invention which is accordingly to be limited only by the following claims.

What is claimed is:

1. A cylinder for a rotary printing press, said cylinder comprising:

a cylinder body, said cylinder body having a circumferentially and axially extending cylinder peripheral surface with a cylinder body width:

at least first and second split channels each extending axially in said cylinder peripheral surface over less than said cylinder body width, said at least first and second split cylinder channels being offset with respect to each other at an angle $\phi$ in a circumferential direction of said cylinder body, said angle $\phi$ of offset of said split channels with respect to each other being a function of an inherent bending frequency of said cylinder body and wherein said angle $\phi$ of offset is between 13° and 21°; and cylinder cover fastening elements in said at least first and second split channels.

2. The cylinder of claim 1 wherein said angle $\phi$ is between 16° and 18°.

3. The cylinder of claim 1 wherein said cylinder body has a rotation frequency $f_{rot}$ and further wherein said angle $\phi$ is determined also as a function of said rotation frequency $f_{rot}$.

4. The cylinder of claim 3 wherein said angle $\phi$ has the relationship $1.2\times(f_{rot}/f_{vib})\times180° \geqq \text{angle } \phi \geqq 0.8\times(f_{rot}/f_{vib})\times180°$.

5. The cylinder of claim 3 wherein said angle $\phi$ has the relationship angle $\phi=(f_{rot}/f_{vib})\times180°$.

6. The cylinder of claim 3 wherein said rotation frequency $f_{rot}$ is selected for the minimum vibration amplitude.

7. The cylinder of claim 1 wherein said cylinder is a forme cylinder.

8. The cylinder of claim 1 wherein said cylinder is a transfer cylinder.

* * * * *